United States Patent [19]

Farman

[11] Patent Number: 4,861,505

[45] Date of Patent: Aug. 29, 1989

[54] NOVELTY SOAP

[76] Inventor: Jacqueline Farman, 345 E. 57th St., New York, N.Y. 10022

[21] Appl. No.: 278,341

[22] Filed: Dec. 1, 1988

[51] Int. Cl.[4] ..... C11D 17/04; C11D 17/00

[52] U.S. Cl. ..... 252/92; 252/90; 252/134; 252/174; 252/DIG. 16

[58] Field of Search ..... 252/90, 92, 134, 174, 252/DIG. 16

[56] References Cited

U.S. PATENT DOCUMENTS

| | | | |
|---|---|---|---|
| 564,717 | 7/1896 | Rider | 252/92 |
| 3,775,881 | 12/1973 | Salan | 40/2 C |
| 3,798,806 | 3/1974 | Sanford | 40/28.1 |
| 4,072,314 | 2/1978 | Rosen et al. | 273/161 |
| 4,100,697 | 7/1978 | Ward | 46/269 |
| 4,285,151 | 8/1981 | Gertler | 40/455 |
| 4,398,982 | 8/1983 | Solomon | 434/259 |

FOREIGN PATENT DOCUMENTS

| | | | |
|---|---|---|---|
| 0740287 | 3/1970 | Belgium | 252/92 |
| 0602915 | 8/1978 | Switzerland | 252/92 |
| 8643 | of 1903 | United Kingdom . | |
| 2155858 | 10/1985 | United Kingdom . | |

*Primary Examiner*—Paul Lieberman
*Assistant Examiner*—Kathleen Markowski
*Attorney, Agent, or Firm*—Morgan & Finnegan

[57] ABSTRACT

There is disclosed a novelty soap bar having disposed in the interior thereof a water-impermeable, preferably plastic, housing containing an electronic circuit including a switch for opening and closing the same and which is programed to send forth a visible signal, tone, melody or message when the switch is closed. In a modification the soap bar is employed in combination with a holder or soap dish and the circuit is actuated when the soap bar is removed from the holder. The circuit switch may be opened and closed by the presence and absence of a magnetic field from one or more magnets located on the holder, or may be a vibration sensitive or temperature sensitive switch. In a modification of the invention, the electronic circuit can be used in combination with a wash mitten.

22 Claims, 4 Drawing Sheets

NOVELTY SOAP

This invention relates to a novelty soap. More particularly, the invention relates to a visible signal, tone, melody or message emitting soap bar which may be employed alone or in combination with a holder, soap dish or wash mitten.

BACKGROUND OF THE INVENTION

Various devices are known which send out signals, such as a flashing or non-flashing light from suitable light emitting device such as light emitting diode, or musical tones or tunes in order to attract the attention of, or amuse a user of the same. For example, U.S. Pat. No. 4,398,892 discloses a musical toy embodying a tone generator having a plurality of spaced apart generator contacts associated with differing musical tones of a musical scale and includes a set of contactor members and a set of receiver members which are adapted to receive the set of contactor members in a fixed predetermined relative position, as well as displacing members for displacing the receiver members while maintaining the fixed relative disposition in juxtaposition to the contacts, so that they are successively actuated by the receiver members in accordance with a predetermined sequence to generate a predetermined sequence of tones.

On the other hand, U.S. Pat. No. 4,285,151 discloses a personal hygiene apparatus for encouraging or instructing a user to employ the same, the apparatus having a non-animated character figure of substantially three dimensional configuration and an audio producing means in combination with an electrically operated tooth brush. The tooth brush is supported by the character figure and removal of the brush for use activates the audio producing means for a given period. The audio producing means recites a melody or message or a combination thereof and will continue to operate when deactivated when the tooth brush is returned to the character figure, or when it is manually deactivated. However, when deactivated, the audio producing means continues to the end of the message or melody then in progress.

In U.S. Pat. No. 4,100,697, there is disclosed a circular light weight hoop having a hollow circular cross-section to which there is removably attached a flexible wire-like element. One end of the wire-like element is removably fitted to a shaft and then through a clutch to an output shaft of a motor which is housed within a portable hand held housing provided with an operating switch and a battery. The hoop contains a pair of ports fluidly communicating atmospheric air to an otherwise sealed compartment within the hoop and a flap panel located near one of the ports directs air into the compartment and out of the remaining port, creating a whistling sound when the hoop is rotated by operation of the motor.

Still further, there is disclosed in U.S. Pat. No. 4,072,314 a sound producing mirror toy which reflects light from its front surface when there is darkness behind it and which becomes transparent when there is light behind it. A representation, such as of a face, and a light source is disposed behind the mirror. An electrical sound producing mechanism is associated with the mirror. The light source and the sound producing mechanism are normally in an inoperative state and activated by a switch which activates the light source and the sound producing means simultaneously .

Still further, in U.S. Pat. No. 3,798,806, there is disclosed a musical greeting card which is formed from a unitary member having a natural hinge for closing and opening the card. The back cover of the card carries a music box or like element, and the front cover carries a resiliently mounted decorative member. The card is maintained closed by communication between the front and back covers in an interference fit relation. However, upon separating the covers to open the card, the music box element is actuated and the decorative member is arranged to pop up, whereupon the decorative member and a suitable greeting on the bottom of the box are exposed to a viewer while at the same time, the music box is activated.

On the other hand, U.S. Pat. No. 3,775,881, discloses an information display apparatus which includes an opaque member having a two-dimensional array of light-transmissive areas arranged in rows and columns. Each area has an individual shutter pivoted for movement between positions in which it has different effects upon light passing through the area and which is operated by a magnetic actuator member coupled with the shutter. Magnetic field producing means in a first set each produce fields limited to all the actuators in a row, while those of a second set each produce fields limited to actuators of a column. Predetermined changes in electric currents applied to the row and the column field producing means uniquely associated with an actuator will produce a reversal of the shutter position and result in different effects upon light passing through the area. The actuators may be soft-iron or permanent magnets and the field producing means for a row may either enable or inhibit actuator movement when energized.

British Patent No. 2,155,858 discloses a message card, such as a gift tag, which has a musical melody module hidden behind an inner non-transparent ply disposed on an outer flap. The ply is sufficiently translucent to allow, under conditions of ambient light, a photosensitive switch of the musical module to be activated when the flap is swung open or away from a rear flap, thus actuating the musical module which then emits a tone through an aperture in the module.

Finally, British Patent No. 8643 discloses a card stand or support for the purpose of displaying printed advertisements relating to articles of merchandise, such as soap, and which comprises a frame or support made of bent and folded material joined together at one portion to form a two-ply section and having interlocking ends which are adapted to form a supporting base for supporting a card or the like upon which advertising material may be disposed.

While the above-mentioned Patents deal with various items which may be used to attract the attention of a user, or may be used to amuse an individual employing the same, none of them disclose or even remotely suggest, a device which can achieve their purposes in a water environment.

There is exists, therefore, a need for a device which can attract the attention of a user, or amuse a user in a water environment, sending forth a visible signal, tone, tune or melody, or a message. The present invention fulfills such a need.

BRIEF STATEMENT OF THE INVENTION

In accordance with the invention, there is provided a novelty soap comprising a soap bar having disposed in the interior thereof a water-impermeable housing containing an electronic circuit including switch means for activating and deactivating the same and which is programmed to send forth a visible signal, tone, melody or message when the switch means is activated. In accordance with a modification of the invention, the soap bar containing the electronic circuit includes in combination therewith a holder or soap dish and the electronic circuit is activated when the soap bar is removed from the holder or soap dish. In another embodiment of the invention, the electronic circuit is employed in combination with a wash mitten.

THE DRAWINGS

In order to describe the inventive novelty soap more fully, reference is directed to the accompanying drawings which are to be taken in conjunction with the following detailed description of the invention and in which drawings.

Figure 3:
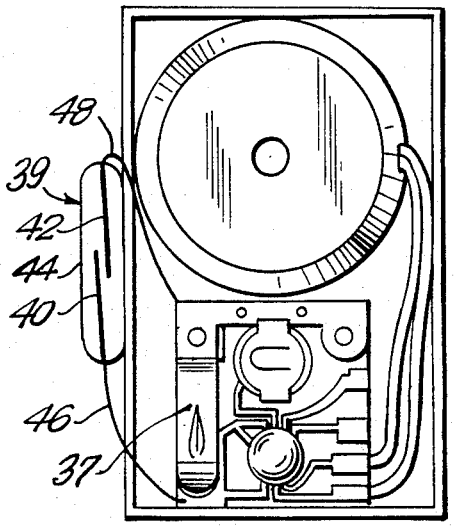
FIG. 3 is a plan view of the electronic circuitry employed in the novelty soap of this invention utilizing a magnetic reed switch.
Figure 11:
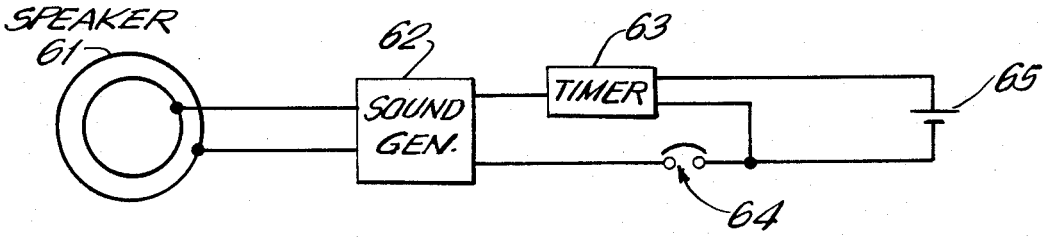
Figure 12:
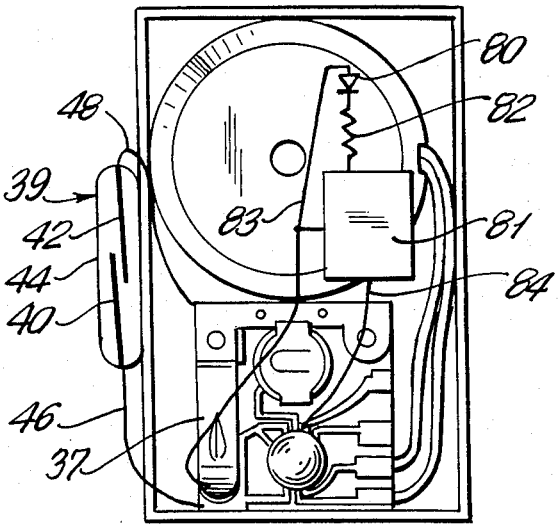

FIG. 11 is a diagrammatic view of the electronic circuit employed in the inventive soap including a timing circuit and a bimetallic or temperature sensitive switch; and FIG. 12 is a plan view of a modification of the electronic circuitry employed in the novelty soap of this invention as illustrated in FIG. 3 and including the incorporation therein of a light emitting diode in which the switch means is bypassed and the circuit sends forth a visible signal when activated.

DESCRIPTION OF THE PREFERRED EMBODIMENTS

Figure 1:
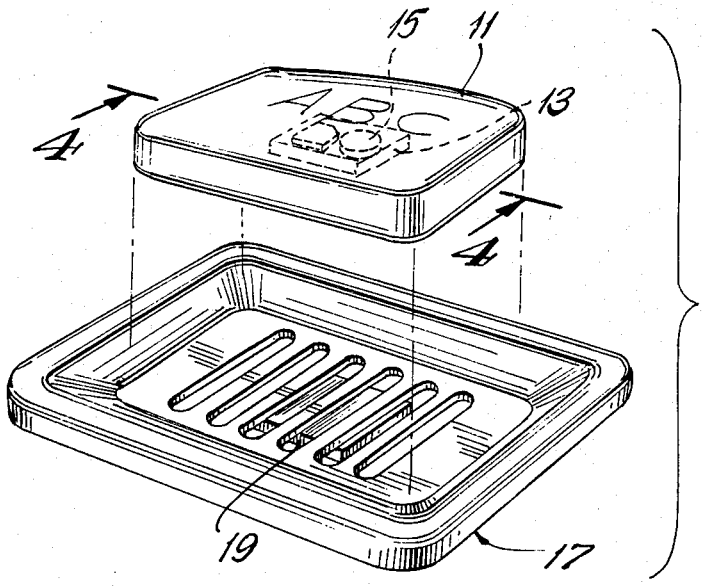
FIG. 1 is an exploded perspective view of a novel soap bar in accordance with the invention employed in combination with a soap dish or holder and illustrating the employment of magnets disposed under the soap dish to activate and deactivate the electronic circuit.

Turning now to FIG. 1, one embodiment of a novelty soap in accordance with the invention, comprises a soap bar 11 having disposed therein a water-impermeable housing 13 which is preferably a plastic container or housing and which contains an electronic module 15, the latter two elements being shown in broken lines. The soap bar 11 when it is not being used rests in a soap dish 17 made of plastic or ceramic or other suitable material and which is provided on its bottom side with one or more magnets 19. The electronic module utilized for providing the tone, musical melody or message comprises a transducer, a synthesizer driver integrated circuit, a battery and a triggering device or contact, as described more fully hereinbelow. While housing 13 may be made from any suitable water-impermeable material, it is preferably made of a plastic material, such as polyethylene, polyester, polyurethane, polyamide, or other suitable plastic, such as plexiglas (molded acrylic sheets), or the like. In its preferred form, the housing is made of rigid plastic and will be at least sufficiently large not only to safely enclose the electronic circuit but large enough also to prevent its being swallowed or even placed in the mouth of a small child utilizing the same as the soap bar diminishes in size upon use. As a practical matter, for purposes of safety and economics, the housing should be at least about 2 inches by 1½ inches by ¾ of an inch, and the soap bar will be large enough to contain the same while providing enough soap so that it lasts at least through several extended periods of use, such as in bathing.

The electronic circuit is provided with suitable switch means, such as a magnetic reed switch 39, (FIGS. 3, 4 and 5), which is deactivated (opened) in the presence of a magnetic field and activated (closed) in the absence thereof. Thus, when the soap bar 11 is resting in place in the soap dish 17, a magnetic field is set up by the magnet 19 which retains the magnetic reed switch (as explained more fully hereinbelow) in an open position and the electronic module will not operate to send forth its programmed visible signal wherein one or more light emitting diodes (LED) are utilized in the circuit, as explained more fully hereinbelow, tone, melody or message. On the other hand, when the soap bar 11 is removed from dish 17, the influence of the magnetic field on the electronic circuit is removed and the magnetic reed switch activates (closes), thus completing the electronic circuit and permitting the circuit to emit its program until the soap is returned to dish 17.

Figure 2:
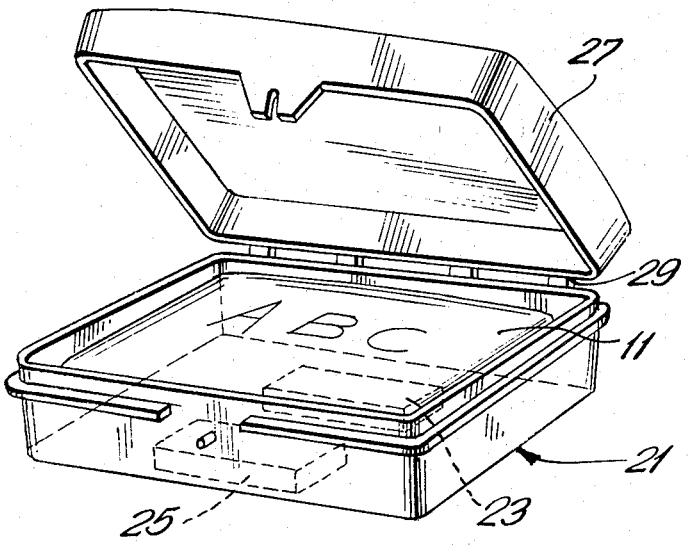
FIG. 2 is a view in perspective of a novelty soap in accordance with the invention employed in combination with a portable holder or container with magnets, shown by broken lines, disposed on the underside of the container to activate and deactivate the electronic circuit.

Turning next to FIG. 2, the modification of the novelty soap illustrated there is substantially the same as the embodiment shown in FIG. 1 except that the soap bar 11 is supported in a portable container 21 and the electronic circuit is contained in housing 23 and held in deactivated (open) or non-active position by magnet 25 located on the bottom of container 21. Container 21 is provided with a lid or cover 27 connected to container 21 by means of suitable straps 29, or hinges and the like.

Container 21 and its associated cover 27 may be made of plastic or ceramic material or any other suitable type of material and, if desirable, may be provided with pleasing aesthetic decorations (not shown) or the like, the cover of the container being held in a closed position thereon by an interference fit or other suitable arrangement or the like.

Figure 8:
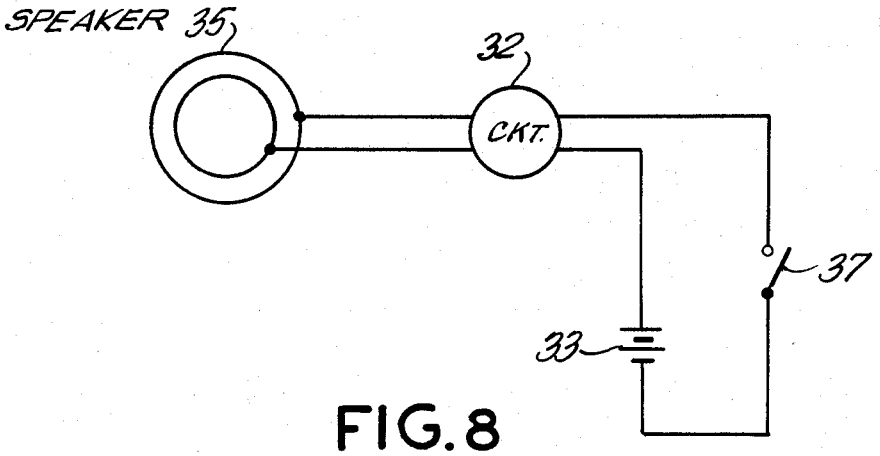
FIG. 8 is a diagrammatic view of the electronic circuit employed in the novelty soap of the invention with the switch means deactivated (open)

Referring now to FIG. 8, a typical electronic circuit which may be employed in the novelty soap of this invention comprises a speaker 35, a synthesizer driver integrated circuit 32, a battery 33, and a suitable triggering device, contact or switch 37 to activate and deactivate the circuit The switch 37 may also be made of suitable temperature-responsive metal, that is, a bimetallic element 64 (FIG. 11) so that it closes as the temperature of the soap bar rises when it is exposed to warm water. Such a switch operates in substantially the same way as switch 37, except that the material from which it is made is heat sensitive so that it will respond to the temperature of warm water. It is to be noted that the basic electronic circuitry employed in the soap of this invention is an off-the-shelf item and when it is employed in the practice of this invention, the triggering device, contact or switch 37 built into the circuitry as delivered does not function in its usual manner in those cases where a magnetic reed switch, such as switch 39, is employed, and may even be removed since the magnetic reed switch 39 is connected into the circuit 31 to bypass switch 37, as explained more fully below. The same is also true where the switch means is a temperature sensitive bimetallic element or a vibration sensitive motion switch as described in more detail below.

Figure 4:
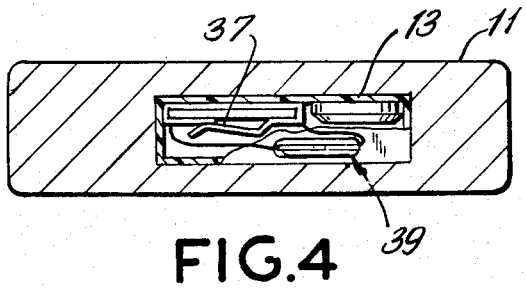
FIG. 4 is a partial sectional view taken through lines 4—4 of FIG. 1 showing the electronic circuitry disposed inside the water-proof plastic container located in the soap and with the switch means activated (closed) and the circuit sending forth a tone, melody or message.
Figure 5:
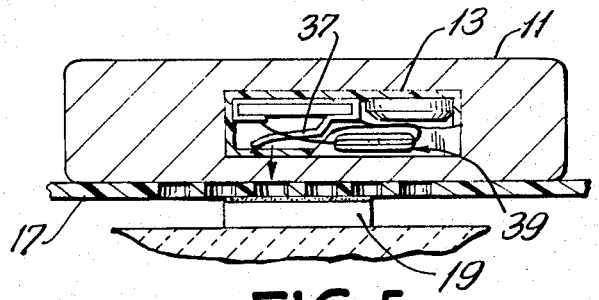
FIG. 5 is a partial sectional view of the arrangement illustrated in FIG. 4 showing the switch means in deactivated (open) position.

Next, referring to FIGS. 3, 4 and 5, a suitable magnetic reed switch 39 comprises a pair of contacts 40 and 42 enclosed in a glass tube 44, the contacts being connected into the electronic circuit by leads 46 and 48.

On the other hand, in addition to being in the form of a magnetic reed switch which is activatable in the absence of a magnetic field or activatable to close in response to temperature, the triggering device, contact or switch 37 may also be employed as the switch means and may be a position actuated or vibration actuated switch, that is, a motion switch which will function to close when the soap bar is not in its rest position, that is, horizontally lying down in a resting position. It is to be understood that when the switch means is a position activated or a vibration sensitive switch or motion switch, that is, a switch which closes when the soap bar is being shaken, as it is being used, or when it is placed in a position other than its resting position, the triggering device, contact or switch 37 may be provided with a biasing spring hinged to its base, (not shown). The precise physical configuration of such a position actuated or vibration sensitive switch (motion switch) can vary. For example, it may be configured physically just the same as the switch 37 in the off-the-shelf electronic module as delivered and illustrated by triggering device, or contact or switch 37, being held in an open position, however, under slight spring tension by provision of a spring at the end where it is connected to the circuitry, such tension being simply neutralized by movement of the soap in use so that the switch triggering device, contact or switch 37 closes and sets the electronic circuit in motion.

Figure 10:
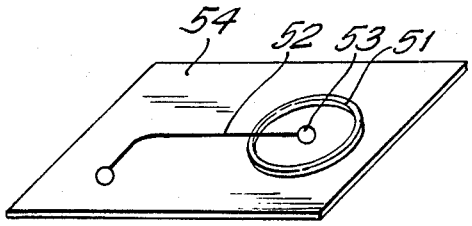
FIG. 10 is a diagrammatic illustration of a motion switch (vibration activated) means for use in the inventive soap of this invention showing the switch in a deactivated position.
Figure 10A:
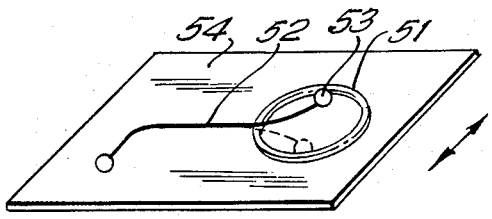
FIG. 10A is a diagrammatic illustration of the motion switch illustrated in FIG. 10 in an activated position.

A more preferred configuration for a vibration sensitive or motion switch is illustrated in FIGS. 10 and 10A. In this more preferred form, the switch is constructed of a metal ring 51 mounted on a non-conductive mounting plate 54 and attached by a lead wire (not shown) in a known manner to the circuitry. A spring steel wire 52 with a metal ball 53 at one end and which is also attached to the non-conductive mounting plate 54 at the opposite end and attached to the circuitry by a lead wire (not shown) in a known manner, being positioned so that the ball 53 is in the center of the ring 51. When a soap bar which contains an electronic circuit provided with such a switching device is subjected to motion, the inertia of the ball bends the spring, and the ball touches the ring, thus establishing electrical contact and activating the circuit. The spring wire and ball are chosen so that the weight of the ball cannot bend the wire sufficiently to touch the ring when the soap bar is at rest.

In the devices so far described, the programmed circuitry will perform its function when the circuit is activated (closed) and the program will be intercepted as the circuit is deactivated (open). It is preferred, therefore, that the circuit be provided with a timing circuit so that once the program is commenced, it will play to conclusion, even if the circuit is deactivated or the program will be repeated so long as the circuit is in an activated state. Such an arrangement is shown in FIG. 11 where the circuit includes a speaker 61, sound generator 62, timing circuit 63, heat sensitive bimetallic element 64 and battery 65.

The timing circuit functions to detect momentary closure of the ring and the ball and produces an output which activates the sound module for a fixed amount of time. Thus, the module will play uninterrupted for a prescribed amount of time even when subjected to a limited amount of motion.

Figure 9:
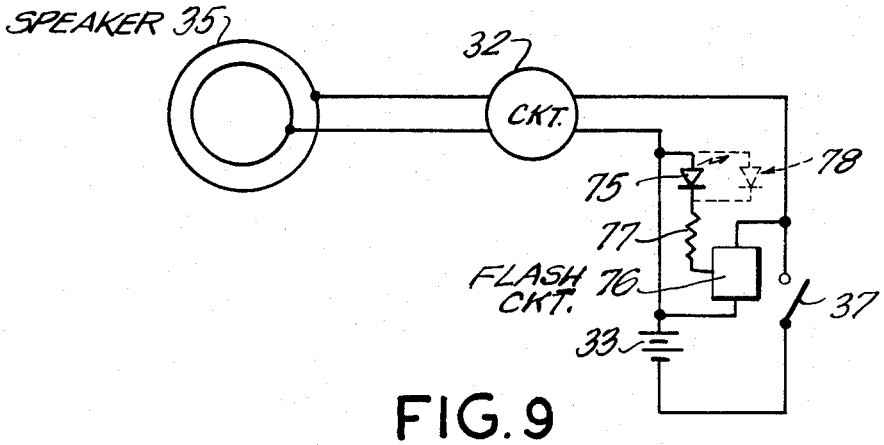
FIG. 9 is a diagrammatic view of the electronic circuit employed in the novelty soap of the invention including a light emitting diode in the circuit or optionally more than one diode as shown in broken lines.

As previously mentioned, a novelty soap bar in accordance with the invention may also include circuitry which furnishes a visible signal, as well as, a tone, melody or message or any of these alone or in any combination. Such an arrangement is illustrated in FIG. 9 where a light emitting diode 75 is included in the circuit. A suitable diode may be a flashing or non-flashing diode and, when employed, the soap bar is preferably a transparent glycerine soap bar and the water-impermeable housing 13 is made of transparent plastic, so that the light signal is visible to a user of the soap bar.

Still further, in such an arrangement the circuit will include a flash circuit 76 and a resistor 77 as shown in FIG. 9. Moreover, optionally more than one diode 78 can be used, if desirable, as shown in broken lines, and such diodes may have different colors, for example, red, green and yellow.

Now referring to FIG. 12 in which the circuitry illustrated in FIG. 3 is modified to include a light emitting diode 80, the circuit also includes a flashing circuit 81, a resistor 82 and leads 83 and 84 to connect the diode and its related elements into the circuitry. As with the arrangement illustrated in FIG. 3, the circuitry shown in FIG. 12 bypasses switch 37.

Figure 7:
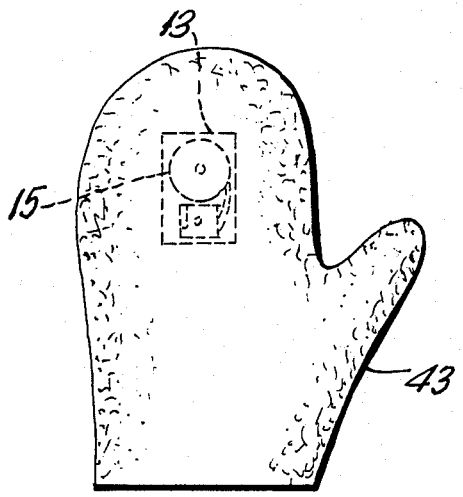
FIG. 7 is a plan view of an embodiment of the invention illustrating the use of the electronic circuit enclosed in a water-impermeable plastic enclosure in combination with a wash mitten.

In the modified embodiment of the present invention illustrated in FIG. 7, the plastic housing 13 containing the electronic circuitry 15 may also be utilized in combination with a wash mitten 43 made of suitable textile material. When so used, the electronic circuitry may be provided with a convenient type of switch such as those described above.

It is to be understood that in the embodiments of the invention illustrated in FIG. 1 and 2, the combination of the described soap bar with the soap dish 17, or container 21, which are provided with magnets, also conveniently results in retaining the circuit in an open position during shipment from a manufacturer to a distributor and, subsequently, to a final consumer, thus preventing premature and undesirable circuit activation. In those cases where the described soap bar is to be packaged and shipped without a soap dish or container (that is, as a replacement soap bar to be used with a previously purchased soap dish or container), the soap bar can be packaged in a paper wrapper or box provided with a magnet or magnets which will simply be discarded by the consumer who will then utilize his previously purchased soap dish or container to accomplish inactivation of the circuit when the soap bar is not in use. In this connection, it is to be further understood that where motion sensitive, vibration sensitive and temperature sensitive switches are employed in the electronic circuitry, switch 37 as included in the off-the-shelf circuitry can be included as an active part of the circuitry, rather than bypassed, and the presence of such a magnet, or magnets will also act to prevent undesirable, premature closing of the circuitry during shipping. In such cases, once a so-provided soap bar is removed from its packaging, switch 37 closes and a motion sensitive, vibration sensitive or temperature sensitive switch in such a circuit would thereafter take over the switching functions, operating in the above-described fashion Z8 when switches of these types are employed in a soap bar in accordance with the invention.

Figure 6:
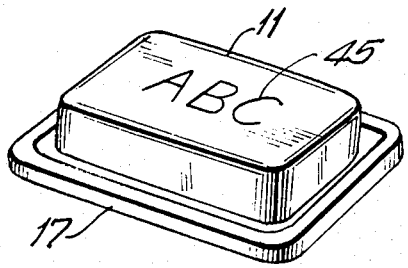
FIG. 6 is a view in perspective of a novelty soap in accordance with the invention disposed in a soap dish in a deactivated position, the electronic circuit thereof being equipped with a temperature actuated or vibration (motion) actuated switch means, neither of which are visible.
Figure 6A:
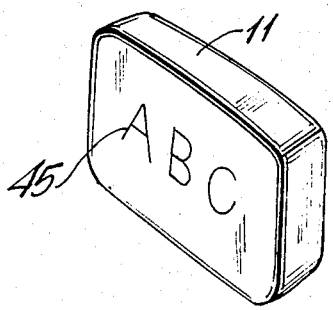
FIG. 6A is a view in perspective of the novelty soap illustrated in FIG. 6 in an activated position.

The novelty soap of this invention provides numerous advantages For example, it is relatively simple to construct. The electronic circuitry is a readily available, off-the-shelf item, as previously mentioned, which may simply be incorporated into a water-impermeable plastic housing of suitable size once the switch means, either magnetic motion sensitive or temperature sensitive, and/or diode has been attached thereto, and then inserted in the soap bar on manufacture thereof. Moreover, where the soap bar is to be utilized in combination with a soap dish or holder and to utilize the principle of opening and closing the electronic circuit by the presence or absence of a magnetic field, the holders may be simply equipped with readily available magnet means. Still further, if desirable, the soap bars employed in the instant invention can be embossed with a manufacturer's logo or the like as shown at 45 in FIG. 6A. Moreover, the housing for the electronic circuitry may be made from readily available plastics and may be varied in size, although it is preferably large enough, as previously mentioned, to prevent swallowing by a small child as the soap is depleted through use.

Numerous other advantages of this invention will be readily apparent from the above-described preferred embodiments of the invention. Accordingly, it is to be understood that numerous variations of this invention may be made without departing from the spirit and scope of the invention and the invention is not to be limited to the described embodiments thereof, except as defined in the appended claims.

What is claimed is:

1. A novelty soap comprising a soap bar having disposed in the interior thereof a water-impermeable housing containing an electronic circuit including switch means for activating and deactivating the same and which is programmed to send forth a visible signal, tone, melody or message when said switch means is activated.

2. A novelty soap according to claim 1, wherein the housing is a water-impermeable plastic housing.

3. A novelty soap according to claim 2, wherein the soap bar is a transparent soap bar, the water impermeable plastic housing is made of transparent plastic and the electronic circuit includes a light emitting diode which sends forth a visible light signal when said electronic circuit is closed.

4. A novelty soap according to claim 3, wherein the diode is a flashing diode.

5. A novelty soap according to claim 2, wherein the housing is made of polyethylene.

6. A novelty soap according to claim 2, wherein the housing is made of polyamide.

7. A novelty soap according to claim 2, wherein the housing is made of polyurethane.

8. A novelty soap according to claim 2, wherein the housing is made of polyester.

9. A novelty soap according to claim 1, wherein the switch means is a magnetic reed switch.

10. A novelty soap according to claim 1, wherein the switch means is a vibration sensitive switch.

11. A novelty soap according to claim 1, wherein the switch means is a temperature sensitive switch.

12. A novelty soap according to claim 1, wherein the switch means is a reed switch which is held open in the presence of a magnetic field and closes in the absence of a magnetic field.

13. A novelty soap comprising in combination (1) a soap bar having disposed in the interior thereof a water-impermeable housing containing an electronic circuit including magnetic reed switch means for opening and closing the same and which is programmed to send forth a visible signal, tone, melody or message when said switch means is closed and (2) a holder for said soap bar having at least one magnet disposed thereon, the magnetic field of said magnet holding said switch means in an open position when said soap bar is in place in said holder and preventing said electronic circuit from sending forth a visible signal, tone, melody or message, said switch means moving to a closed position when said soap bar is removed from said holder and from said magnetic field of said magnet and permitting said electronic circuit to send forth said visible signal, tone, melody or message.

14. A novelty soap according to claim 13, wherein the housing is a water-impermeable plastic housing.

15. A novelty soap according to claim 14, wherein the soap bar is a transparent soap bar, the water-impermeable plastic housing is made of transparent plastic and the electronic circuit includes a light emitting diode which sends forth a visible light signal when said electronic circuit is closed.

16. A novelty soap according to claim 15, wherein the diode is a flashing diode.

17. A novelty soap according to claim 14, wherein the housing is made of polyethylene.

18. A novelty soap according to claim 14, wherein the housing is made of polyamide.

19. A novelty soap according to claim 14, wherein the housing is made of polyurethane.

20. A novelty soap according to claim 14, wherein the housing is made of polyester.

21. A novelty soap according to claim 14, wherein the switch means is a reed switch.

22. A novelty soap according to claim 14, wherein the holder is a portable holder provided with a hinged cover.

* * * * *